US008011903B2

(12) United States Patent
Pollack

(10) Patent No.: US 8,011,903 B2
(45) Date of Patent: Sep. 6, 2011

(54) SYSTEMS AND METHODS FOR ENERGIZING AND DISTRIBUTING FLUIDS

(76) Inventor: Robert William Pollack, Chappaqua, NY (US)

( * ) Notice: Subject to any disclaimer, the term of this patent is extended or adjusted under 35 U.S.C. 154(b) by 0 days.

(21) Appl. No.: 12/819,557

(22) Filed: Jun. 21, 2010

(65) Prior Publication Data

US 2010/0260624 A1 Oct. 14, 2010

Related U.S. Application Data

(63) Continuation of application No. PCT/US2009/038056, filed on Mar. 24, 2009.

(60) Provisional application No. 61/039,429, filed on Mar. 26, 2008, provisional application No. 61/054,805, filed on May 20, 2008.

(51) Int. Cl.
*F04B 17/03* (2006.01)

(52) U.S. Cl. ..... 417/420; 417/374; 310/15; 310/80

(58) Field of Classification Search ..... 417/410.1, 417/420, 374; 310/15, 20, 80
See application file for complete search history.

(56) References Cited

U.S. PATENT DOCUMENTS

| | | | | |
|---|---|---|---|---|
| 1,572,126 | A | 2/1926 | Bothner | |
| 2,872,101 | A | 2/1959 | Ryba | |
| 2,992,342 | A * | 7/1961 | Schmidt et al. | 310/15 |
| 3,196,797 | A | 7/1965 | Marini | |
| 3,443,128 | A * | 5/1969 | Fakan | 310/10 |
| 4,032,264 | A | 6/1977 | Takahashi | |
| 4,541,787 | A | 9/1985 | DeLong | |
| 4,671,745 | A * | 6/1987 | Smith | 417/419 |
| 5,603,612 | A | 2/1997 | McGrath | |
| 6,283,720 | B1 | 9/2001 | Kottke | |
| 6,540,491 | B1 | 4/2003 | Tanabe | |
| 2002/0167236 | A1 * | 11/2002 | Long | 310/80 |
| 2006/0244327 | A1 * | 11/2006 | Kundel | 310/113 |
| 2008/0008609 | A1 | 1/2008 | Pate et al. | |

FOREIGN PATENT DOCUMENTS

WO WO-2009120670 A1 10/2009

OTHER PUBLICATIONS

International Search Report and Written Opinion of the International Searching Authority (ISA) dated Sep. 1, 2009 for PCT/US2009/038056 (8 pages).

PCT/US2009/038056, Oct. 7, 2010, International Preliminary Report on Patentability.

* cited by examiner

*Primary Examiner* — Charles Freay
*Assistant Examiner* — Patrick Hamo
(74) *Attorney, Agent, or Firm* — Edwards Angell Palmer & Dodge LLP; Brian R. Pollack, Esq.

(57) ABSTRACT

The present disclosure provides various pumps and compressors for energizing fluids. In accordance with a preferred embodiment, pumps are provided for compressing hydrogen gas produced by electrolysis at a first location. The pump includes a bore with a piston disposed in the bore, and a magnetic drive external to the bore. The piston is moved through the bore to compress the fluid using permanent magnets or electromagnets. Using the disclosed embodiments, hydrogen compressed at a first location can be directed to a second location, such as a power plant or a fueling station.

18 Claims, 8 Drawing Sheets

SYSTEMS AND METHODS FOR ENERGIZING AND DISTRIBUTING FLUIDS

CROSS-REFERENCE TO RELATED APPLICATION

This patent application is a continuation of and claims the benefit of priority to International Application No. PCT/US2009/038056, filed Mar. 24, 2009, which in turn claims the benefit of priority to U.S. Provisional Patent Application Ser. No. 61/039,429, filed Mar. 26, 2008, and U.S. Provisional Patent Application Ser. No. 61/054,805, filed May 20, 2008. The disclosure of each of the aforementioned applications is incorporated by reference herein in its entirety.

BACKGROUND OF THE INVENTION

1. Field of the Invention

The present invention relates to systems and methods for energizing and distributing fluids. Particularly, the present invention is directed to systems and methods for pumping fluids.

2. Description of Related Art

Hydrogen gas will likely be the fuel of the next era. Specifically, fuel cells, hydrogen fueled automobiles, and systems yet to be developed will likely use hydrogen for fuel as fossil fuels become more expensive and as their supplies become depleted.

The generation of electricity through renewable resources, such as water power, wind, solar, tides, and the harnessing of ocean currents must be stored as this energy is lost if it is not used at the time it is created.

Additionally, the use of high tension wires operating at high voltages for the transmission of electricity over long distances is extremely wasteful due to phenomena such as the Corona effect. These losses are directly proportional to the transmission distance. This makes access to remote sources of water power generation, wind power, tidal forces, ocean currents and other sources generally impractical. Any such power made in remote regions would likely be nearly depleted by the time it arrived at a significant population center, possibly thousands of miles away.

Hydrogen powered automobiles and other similar systems will require enormous amounts of this substance in order to be a practical fuel source. Some attempts have been made at addressing problems of hydrogen production, such as by using water as a hydrogen source wherein electrolysis may be used to produce the hydrogen fuel. Additionally, vehicles may be provided with on-board electrolysis processors (a.k.a. electrolyzers) for converting water into gases to be consumed to generate power. However, the total efficiency is severely reduced because of the aforementioned problem of electrical power distribution. Various advances have been made in storing hydrogen in cooperation with various materials to form hydrogen-metal complexes. However, this does not provide a realistic solution for compression and storage of large quantities of hydrogen fuel.

The direction of present hydrogen-powered vehicles by the U.S. Department of Energy in pilot projects is to electrolyze water with electricity from the grid, at the locations where the fuel is dispensed into vehicles equipped with fuel cells that convert the gases back into electricity, driving electric motors.

However, it has been recognized that hydrogen cannot be compressed well by most existing compressors without substantial losses. This is because the small hydrogen molecule ($H_2$) can easily slip past seals and even migrate through metal walls if given sufficient time. External compressors, which can easily be sealed against air and most gases effectively, can not prevent substantial losses of hydrogen. Diaphragm, hermetically sealed and centrifugal pumps also have drawbacks. To the best of Applicant's knowledge, previous attempts, other than cryogenic refrigeration to temperatures approaching absolute zero to liquefy hydrogen, have been unable to condense hydrogen successfully. The cryogenic approach is similarly unattractive due to the need to maintain cryogenic temperatures, which is extremely wasteful from an energy balance standpoint. As described herein, it is respectfully submitted that the present disclosure will facilitate use of hydrogen as a practical, viable source of energy.

SUMMARY OF THE DISCLOSURE

The purpose and advantages of the present invention will be set forth in and become apparent from the description that follows. Additional advantages of the invention will be realized and attained by the methods and systems particularly pointed out in the written description hereof, as well as from the appended drawings.

To achieve these and other advantages and in accordance with the purpose of the disclosed embodiments, as illustrated herein, the disclosure includes a fluid pump. The pump includes a generally sealed vessel defining a bore therein. Preferably, the only passages through the vessel leading into the bore include at least one working fluid inlet and at least one working fluid outlet. The pump further includes a piston adapted and configured to be received in the bore. The pump also includes a magnetic drive external to the bore, wherein the magnetic drive is adapted and configured to cause the piston to move along a path defined by the bore when the drive is actuated.

In further accordance with the disclosure, the bore may be generally straight or generally toroidal in shape. In accordance with a preferred embodiment, the pump is adapted and configured to pump hydrogen. If desired, the pump may include at least one check valve in the fluid path of at least one of the working fluid inlet and the working fluid outlet. In accordance with one embodiment, the piston includes a plurality of seals disposed about its periphery adjacent the bore. The bore may have a circular cross-section or a non-circular cross-section, as desired.

In accordance with a further aspect, gas passing over the seals during a compression stroke may be recovered and compressed during a subsequent compression stroke of the pump. If desired, the piston may include a bore through the center thereof to permit the passage of gas therethrough during a non-compression stroke. In accordance with a further aspect, the piston may include non-magnetized iron material, permanently magnetized material, and/or diamagnetic material.

In accordance with one embodiment, the magnetic drive includes at least one electromagnet. Accordingly, the direction and rate of travel of the piston may be controlled by the amount of current in the electromagnet. In accordance with another embodiment, the magnetic drive may include at least one permanent magnet. In accordance with a preferred embodiment, the magnetic drive may include at least two permanent magnets. Preferably, the direction and rate of travel of the piston is controlled by the movement and strength of the permanent magnets.

In accordance with a further aspect, the pump preferably includes a vessel that is non-magnetic. For example, the vessel may include stainless steel or polymeric material. In accordance with a further aspect, the magnetic drive may include at least one electromagnet disposed at either end of the bore. In accordance with a preferred embodiment, the piston and/or electromagnets may include ferromagnetic material.

In accordance with an illustrative embodiment, the disclosure provides a method of compressing a gas. The method includes providing one or more pumps as described herein, drawing working fluid into the inlet by moving the piston through the bore in a first direction, and compressing the fluid by moving the piston through the bore in a second direction opposite from the first direction.

In accordance with a further aspect, the method may further include compressing fluid that slips between the piston and the bore in a subsequent compression stroke. In accordance with a preferred embodiment, the working fluid may include hydrogen gas. Even more preferably, the hydrogen gas is produced by electrolysis. The hydrogen may be transported to a second location after being compressed by the pump, such as in a vehicle or through a pipeline. If desired, the oxygen produced by the electrolysis process may also be compressed and sent to the second location. In accordance with a preferred embodiment, the electricity used to produce the hydrogen from electrolysis is obtained from a renewable energy resource. The renewable energy resource may be selected, for example, from the group including wind power, hydroelectric power, solar power or tidal power. In accordance with a further aspect, the second location may be a power plant or a vehicle fueling station, among others.

It is to be understood that both the foregoing general description and the following detailed description are exemplary and are intended to provide further explanation of the embodiments disclosed herein.

The accompanying drawings, which are incorporated in and constitute part of this specification, are included to illustrate and provide a further understanding of the methods and systems of the disclosed embodiments. Together with the description, the drawings serve to explain the principles of the disclosed embodiments.

DETAILED DESCRIPTION OF THE PREFERRED EMBODIMENTS

Reference will now be made in detail to the present preferred embodiments of the invention, examples of which are illustrated in the accompanying drawings. The methods and corresponding steps of the invention will be described in conjunction with the detailed description of the system.

The present disclosure is directed principally to various embodiments of pumps and compressors that use electromotive forces to actuate a working body, such as a piston, inside a vessel, to compress gas or move liquids. Such embodiments may be suitably configured, for example, to pump liquids, to pump gases, or a mixture of liquids and gases, as desired. In the context of the present disclosure, the terms pump and compressor are generally used interchangeably and are intended to refer to a device that is capable of adding pressure energy to a fluid, be the fluid liquid and/or gaseous in nature. Such embodiments are particularly advantageous since they eliminate a number of sources of leakage inherent in prior art devices, yet still permit for significant compression ratios and efficient operation. Use of such low-loss devices is particularly advantageous for compressing gases that are prone to leakage, such as hydrogen and other light gases.

Previous attempts have been made at developing electromagnetically actuated compressors, such as those described in U.S. Pat. Nos. 1,572,126, 2,872,101, 3,196,797, 4,032,264, 4,541,787, 5,603,612, and 6,540,491. Each of these references is incorporated by reference herein in its entirety. However, Applicant believes that these attempts do not possess the advantages of the disclosed embodiments. For example, the disclosed embodiments use electromagnetic induction (i.e., Faraday's law) to drive the compressing piston from outside a vessel containing the piston. All motivating and controlling parts of the device are external and accessible for maintenance without violating the integrity of the vessel envelope or its contents. U.S. Pat. No. 4,541,787 to DeLong utilizes a piston internal to the vessel. Applicant believes that the embodiments of DeLong are not intended (nor suitable) for the compression of light gases such as hydrogen, but instead are intended for the pumping of heavy fluids such as crude oil from oil wells.

Figure 7:
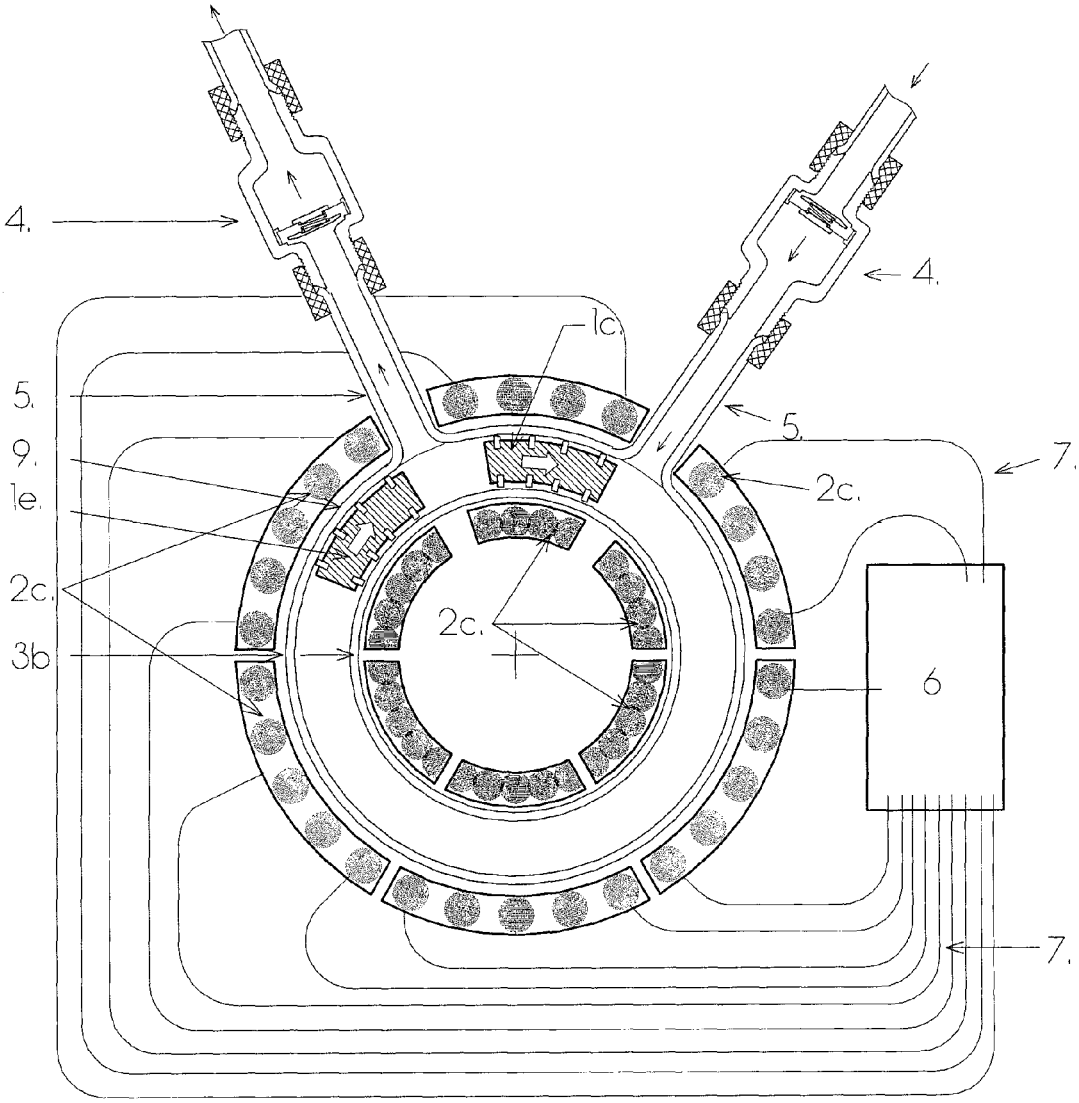
FIG. 7 is a sectional view of a fifth representative embodiment of a device made in accordance with the present invention.

For purposes of illustration and not limitation, as embodied herein, FIGS. 1-4, 7 and 10-13 depict various embodiments of pumps or compressors made in accordance with the invention. FIGS. 1-4 and 10-13 depict various linear reciprocating devices whereas FIG. 7 depicts a device that follows a circular track.

As a gas compressor, it is submitted that the disclosed devices are operable with working fluids such as air or any other gas. As a liquid pump, the disclosed devices can be used to pump most liquids. It is believed that due to the simplicity of the devices, they can operate with little maintenance. It is further believed that the device will consume less power than present compressors or pumps of similar output.

As mentioned above, FIG. 1 depicts an exemplary device (compressor/pump) with a piston containing a reed or other type of one-way valve in its head. It has a wound coil surrounding a non-magnetic (e.g., stainless steel and/or polymeric) cylinder, and both the intake and compression are activated by reversing polarity of the applied current. This may be achieved, for example with a mechanical or electronic commutator, pin diode actuated circuits, and the like.

Figure 1:
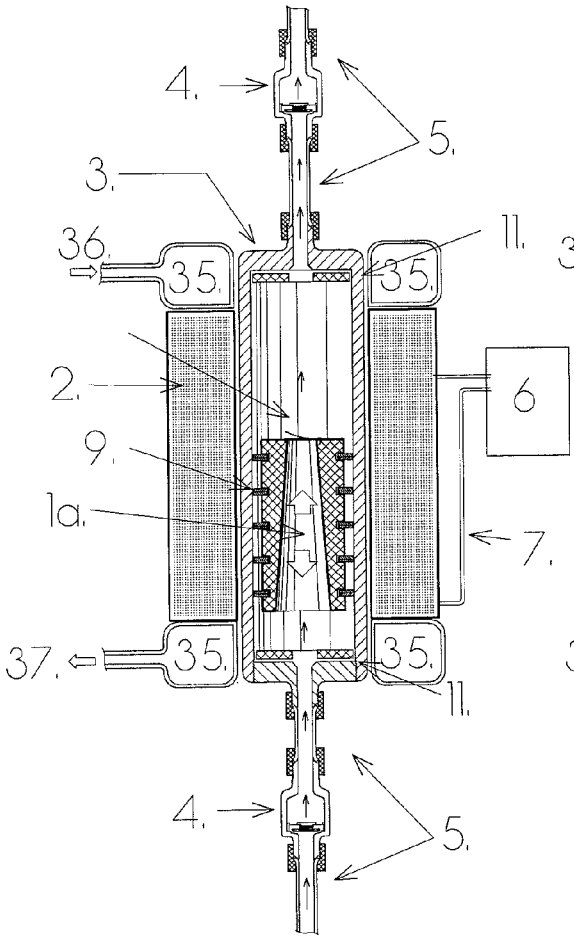
FIG. 1 is a sectional view of a first representative embodiment of a device made in accordance with the present invention.

Specifically, FIG. 1 illustrates a section through a single acting compressor/pump made in accordance with the teachings herein. Piston 1*a*, disposed within cylinder/housing 3 may be made from a variety of materials, depending on the intended principle of operation of the device as described herein.

For example, the movement of piston 1*a* (or other pistons described herein) may be accomplished by means of magnetic attraction. If based on magnetic attraction, the piston preferably includes magnetically-attractable material such as a paramagnetic material (e.g., magnesium, molybdenum, lithium, and tantalum or suitable alloys thereof) or ferromagnetic material (e.g., iron) or other magnetizable material (e.g., Alnico, neodymium-iron-boron, samarium-cobalt, or standard ceramic magnet materials and rare earth magnet materials).

By way of further example, the movement of piston 1*a* may be based on magnetic repulsion. If based on magnetic repulsion, the piston 1*a* preferably includes diamagnetic material (e.g., copper, silver, and gold, alloys thereof, suitable high-temperature superconductors ("HTS"), and the like). As understood by those of skill in the art, such repulsion typically occurs in the form of Eddy currents induced in the diamagnetic material in response to an applied time varying electromagnetic field. The Eddy currents create a repulsive magnetic field which interacts with and is repulsed by the applied magnetic field, resulting in piston movement.

It will be further appreciated that the movement of piston 1*a* can be accomplished via the combined attraction and repulsion of magnetic fields, wherein a piston can be made from both diamagnetic and paramagentic material. Accordingly, piston movement may be accomplished by controlling the application of electromagnetic fields to the device to create fields with controlled orientation to attract or repel the piston, as desired. It will be appreciated by those of skill in the art that any electromagnetically-actuated embodiment of a pump therein may be adapted and configured to control the application of current to the windings thereof in a manner appropriate to the material of the piston.

Piston 1*a* may be plated or coated, as desired, particularly if the fluid being compressed or pumped is corrosive. As depicted, piston 1*a* also contains a hollow center to allow gas to pass through on the intake stroke. An exemplary electromagnetic coil 2 is wound around and attached to the outside of the housing 3. Polarity may be reversed, as desired, to alternately repel or attract piston 1*a*, resulting in intake and compression.

Housing 3 (which may be cylindrical or any other suitable shape) is preferably closed at the ends except for the inlet and outlet passages 5. Housing/cylinder 3 is preferably made from a non ferromagnetic, and preferably a paramagnetic material such as a stainless steel, polymeric and/or composite (e.g., ceramic containing) materials.

As further depicted, a check valve 4 is disposed at each end of the housing 3. Check valve 4 is preferably of suitable design and material for the substance being compressed or pumped. Check valve 4 can be electrically operated, for example, where hydrogen or other light gas, due to being in the early stages of compression, may not be able to open a spring actuated valve on its own. The valve activation can be synchronized, for example, with the piston position. Inlet and outlet lines 5 are also provided. A control unit 6 may reverse the polarity in the induction coil causing the piston to move into the intake direction and power stroke. Control unit 6 may include, for example, mechanical means such as a commutator in an electric motor. The speed of the device (frequency of cycles) can be varied by the speed of the rotation of the commutator. By way of further example, control unit 6 may include suitable processors and switches, such as pin diodes or other switches or relays, that controllably energize coil 2. Accordingly, the control unit 6 preferably can vary the intensity of the electromotive force of the piston, and preferably provides greater force on the power stroke and less force on the intake stroke. Power to the coil can be controlled to adjust the movement to prevent collision of the piston against the ends of the cylinder. Reference 7 indicates the linking wiring from the control unit 6 to the coil 2. Reference 8 indicates the check valve or one-way valve in piston 1*a*. Reference 9 indicates the piston seals or rings. Seals 9 can be made of any suitable material, such as metal, composite and/or plastic material such as PTFE.

Because the movement of the device in FIG. 1 is completely linear (as opposed to crankshaft driven pistons which tend to add rocking to the motion which creates wear on parts of the cylinder wall), there are accordingly less sources of wear in the disclosed embodiment. As illustrated, dampers 11 are also provided proximate the ends of housing 3 to absorb shock. If desired, cooling manifolds 35 having an inlet 36 and outlet 37 may be used to cool the electromagnetic coil 2. As will be appreciated by those of skill in the art, cooling manifolds 35 can be configured in any desired manner, and may use active and/or passive cooling. For example, cooling manifolds 35 may simply include a heat sink and fin array or may include active cooling components such as fans, or may use a fluid jacket with an inlet and outlet as depicted. If using a fluid jacket, various working fluids may be used such as compressed or forced air, a refrigerant (e.g., R134), water, fluorine-containing coolants sold under the tradename Fluorinert™ liquid nitrogen or the like.

As further mentioned above, FIG. 2 depicts a similar exemplary device (compressor/pump) with a piston having a shaft through the center and a seal such as an "O" ring. The shaft is affixed to the cylinder body and remains stationary during movement of the piston. The hole through the piston is tapered through a portion of its length wherein the seal enters that part of the piston during the intake part of the stroke, allowing gas to enter the compression chamber. In the power or compression stroke, the majority of the motion occurs while the seal portion is in the tighter, evenly bored portion. This is because, in the case of hydrogen, the low mass hydrogen gas may not achieve enough pressure on intake to open the valve. This means of opening the intake chamber to the compression chamber may also prevent inertial problems with the one-way piston valve of the device illustrated in FIG. 1.

Figure 2:
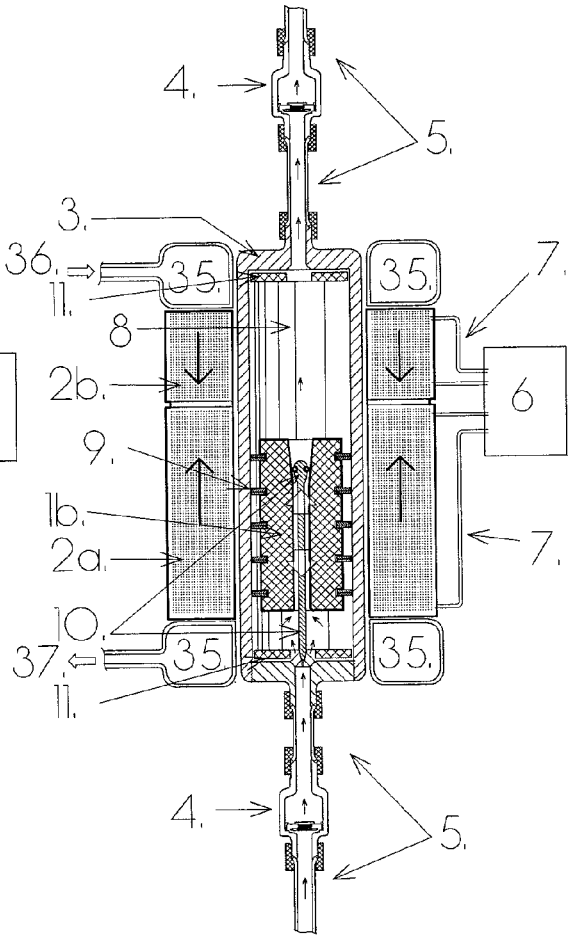
FIG. 2 is a sectional view of a second representative embodiment of a device made in accordance with the present invention.

The embodiment of FIG. 2 is similar to the device in FIG. 1 except for the following: Piston 1*b* does not have a check valve or one way valve. Instead, the passage within the piston 1*b* is opened and closed by a rod of reduced diameter to the smooth constant bore portion of the piston 1*b*. Preferably, the rod is formed of non-magnetic material. There is an increased diameter portion near the tip with an "O" ring seal (or other suitable seal). The other end of the rod is affixed to the intake end of the cylinder body. During the intake stroke the "O" ringed end enters a larger, tapered portion of the center bore of the piston allowing the compressed fluid to flow around the seal. The compression stroke begins to move the piston so that the gasketed end enters the even bore, closing the passage compressing the gas at the head and drawing new gas into the inlet side. Check valves 4 prevent back-flow of the fluid.

Figure 3:
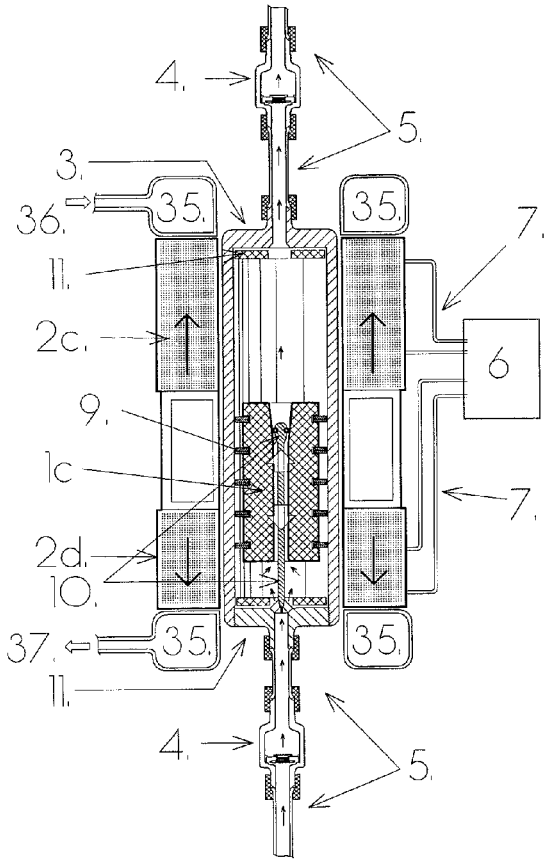
FIG. 3 is a sectional view of a third representative embodiment of a device made in accordance with the present invention.

FIG. 3 depicts a section through a third similar exemplary single action compressor/pump. The embodiment of FIG. 3 is similar to that of FIG. 2, with the exception that two discrete electromagnetic coils 2*c* and 2*d* are provided. It will be appreciated that any suitable number of sequential coils may be provided. It is preferable to use a ferromagnetic piston. When using a ferromagnetic piston, the fields generated by the coils 2*c*, 2*d* may be optimized to attract the piston in opposing directions with varying field strength over time. As will be appreciated by those of skill in the art, the current profiles can be altered in the coils if a piston made of magnetized material is used to take advantage of the inherent magnetization of the piston. By way of further example, it will be appreciated that the operation of coils 2*c*, 2*d* can be optimized for the use of diamagnetic material in the piston, wherein the piston can be driven by repulsive forces. As with the embodiments of FIGS. 1-2, cooling manifolds 35 and seals 9 are depicted.

Figure 4:
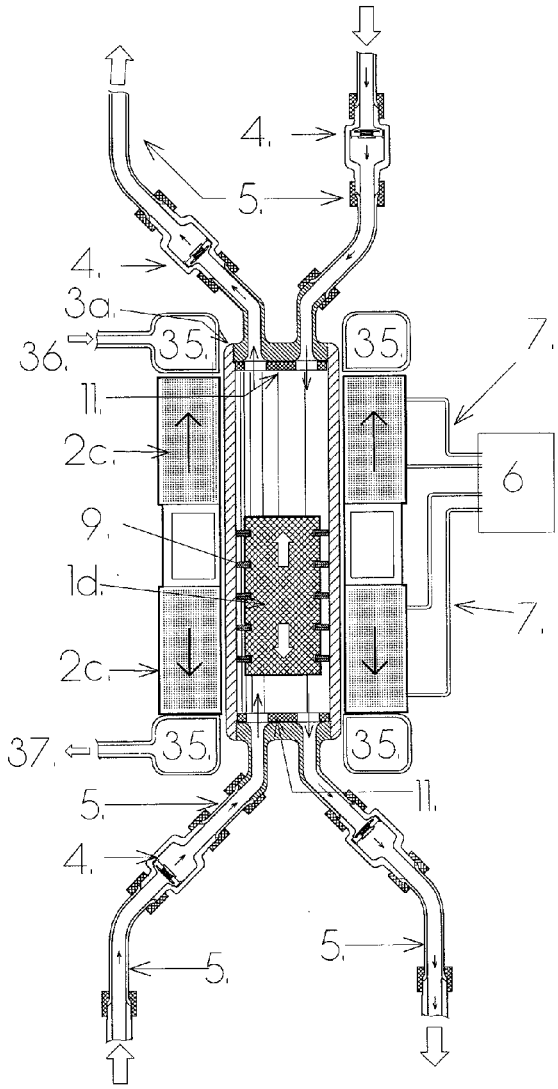
FIG. 4 is a sectional view of a fourth representative embodiment of a device made in accordance with the present invention.

FIG. 4 is a section through a fourth exemplary compressor/pump design. In contrast to the embodiments of FIGS. 1-3, the embodiment of FIG. 4 is a double-action device that permits compression during each movement of the piston 1*d*. The embodiment of FIG. 4 also preferably has an iron piston 1*d*, but the piston 1*d* has a solid body without a center passage as with the previously-described embodiments. The compressor/pump of FIG. 4 has intakes and outlets 5 at each end. Alternately, each side of the cylinder is both an intake and compression chamber. When the piston 1*d* moves in one direction, it draws in new gas or fluid on one side and compresses it on the other. Each stroke is thus a compression stroke and an intake strokes. Check valves 4 regulate flow direction. As with the embodiments of FIGS. 1-3, cooling manifolds 35 and seals 9 are depicted.

Figure 5:
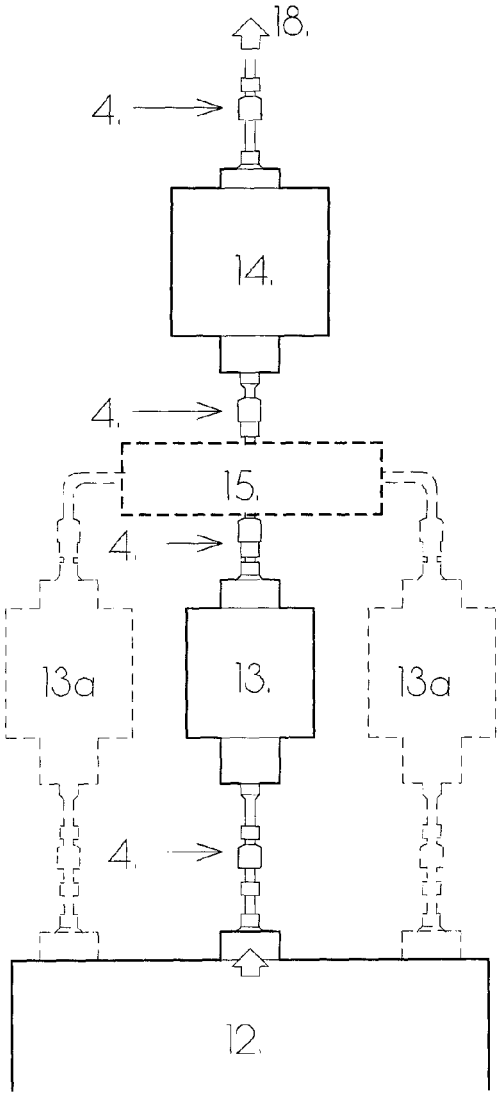
FIG. 5 is a schematic view of an assembly of devices made in accordance with the present invention.

FIG. 5 is a schematic view of an exemplary assembly of single action compressors (such as those depicted in FIGS. 1-3) arranged for staged compression that is necessary to create pressures higher than those that can be achieved by a single stage of compression. The schematic view is only a portion of a staging system as might be required for the compression of hydrogen or other fluid to approximately 10,000 psi. which has been indicated as being the degree of pressure required for practical use in automobiles. The assembled system includes a reservoir 12 including working fluids, for example, diatomic hydrogen or oxygen stored at one atmosphere such as after electrolyzing water into these components. If all of the compressors, 13, 13*a*, 14 were of the same size and output, staging may require several compressors outputting a lower pressure of gas feeding the next stage compressor. This staging may be repeated until the final pressures are achieved. A series of tanks or manifolds 15 may be provided to collect the pressurized working fluid of a plurality of compressors for inlet into the next higher stage of compression. As with earlier embodiments, check valves 4 are used to prevent back-flow. The assembly further includes a high pressure outlet 18 that directs the working fluid into a further stage of compression or storage vessel.

Figure 6:
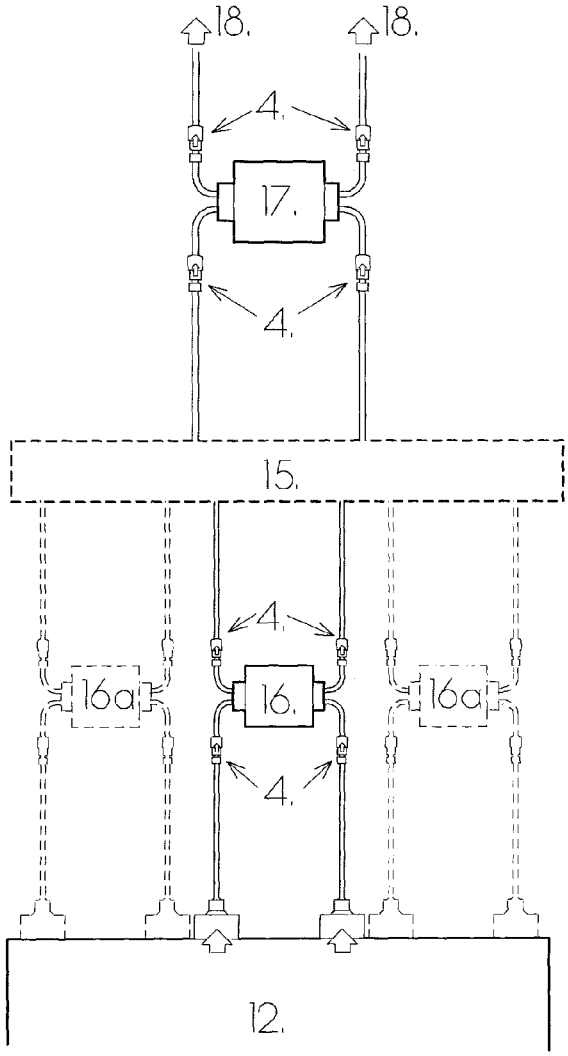
FIG. 6 is another schematic view of an assembly of devices made in accordance with the present invention.

FIG. 6 is a schematic view of an exemplary assembly of double-action compressors (such as that depicted in FIG. 4) arranged for staged compression. As with the previous schematic view, this illustrates part of a staged compression system. Compressors 16, 16*a*, and 17 can have approximately the same output which may require a plurality of lower stage compressors to supply gases of and elevated pressure to the next stage of compression. 12 is the lower or atmospheric pressure vessel and 15 is an intermediate pressure vessel or manifold supplying the next stage of compression. 18 indicates the higher pressure outputs feeding the manifold or storage vessel for the next stage of compression.

When connecting pump/compressor devices as described herein in assemblies, it is submitted that those of skill in the art can readily determine how many cycles of a given pump/compressor are needed to increase hydrogen gas or other fluid pressure up to a desired density and pressure.

As alluded to above, FIG. 7 illustrates a rotary compressor wherein the pistons are disposed inside of a vessel that is generally toroidal in shape. Specifically, FIG. 7 is a section through a fifth embodiment of a pump/compressor that has a rotary configuration. The embodiment of FIG. 7 includes toroidal-shaped housing 3*b* and curved pistons 1*c* and 1*e*. While two pistons are shown, though in application a plurality greater than two may be used, as desired. Preferably, the pistons are made from iron or permanent magnet material. The cross section of the piston and chamber may be any desired shape, such as round, oval, generally D-shaped, kidney bean shaped or the like. If D-shaped or kidney bean shaped, the outwardly rounded portion of the cross-section is preferably directed toward the outer periphery of the toroidal vessel. The controlling electromagnets 2*c* in a segmental arrangement distributed around the toroid propel one piston around most of the cylinder sequentially while the other piston is held stationary by the controlling electromagnets as a stop for the first piston to compress the gas against. Then the second piston assumes the role of the compressing piston with the first piston taking the stationary position for the next compression stroke. If the piston includes iron, the sequencing of the activation of electromagnets can be programmed to pull the piston around the circuit.

With further reference to the embodiment of FIG. 7, if the pistons 1*c*, 1*e* are fabricated from a permanent magnet, the sequencing can be programmed to repel the piston around the circuit from one side and to attract the piston from the other side. If the piston is fabricated from diamagnetic material, the sequencing can be programmed to repel the piston around the circuit. The cycle is repeated continually. The toroidally shaped housing 3*a* may be made, for example of a non-magnetic metal (such as high nickel stainless steel) or composite or plastic material, as desired. One inlet passage 5 and one outlet passage 5 are depicted, though a plurality of inlets and outlets are possible and may be desirable in some applications. Inlet and outlet check valves 4 of a mechanical type may be provided, as desired, although electrically operated valves synchronized to the phasing of the pistons 1*c*, 1*e* may be desirable for light gases in the early stages of compression. As with the earlier embodiments, a control unit 6 is provided that may be generally electrical or electromechanical in nature or include a solid state controller to control movement of the pistons 1*c*, 1*e* and/or opening and closing the check valves 4. Wiring or other media 7 is provided to link the electromagnetic coil segments and the valves (if desired), to the control unit.

Figure 8:
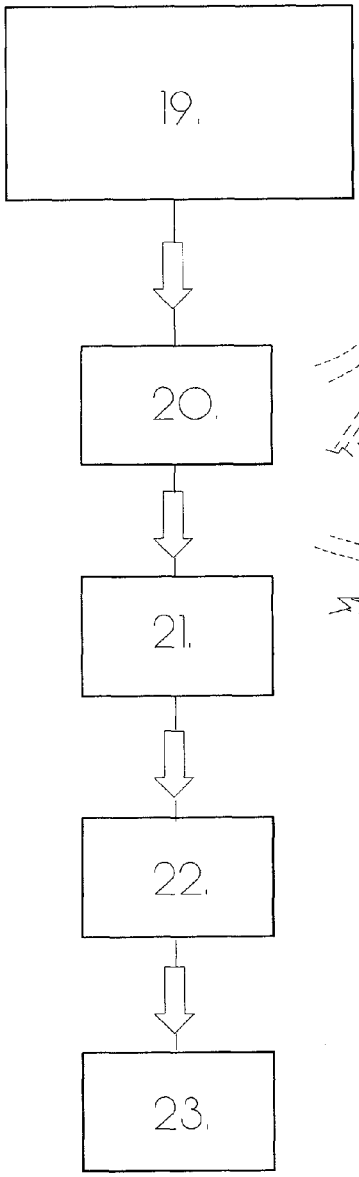
FIG. 8 is a schematic diagram of a hydrogen fuel cycle.

FIG. 8 depicts a diagram of a hydrogen fuel cycle showing the creation of hydrogen and oxygen gas from water, the compression of both gases, piping or transport of the fuel to population centers and the consumption of the fuel creating heat and water in traditional power plants, for powering fuel cells or for sale at fueling stations for vehicles, and/or for distribution to homes and other types of buildings and processes.

Specifically, FIG. 8 is a diagram of a hydrogen fuel cycle as likely will occur in the near future in accordance with the invention. A particular source of power 19, preferably but not necessarily renewable power, is depicted. For example, areas where unrelenting wind exists can have wind-driven generator farms, heretofore untapped water power, tides, ocean currents, solar and geothermal in remote locations as well as off-peak hydro power from existing plants that can be processed for energy storage. It will be further recognized that conventional sources of electricity may also be used. An electrolysis facility 20 may be provided where water may be separated into its component parts, oxygen and hydrogen, by way of the locally generated electricity. A compression unit 21 (including a plurality of pumps as described herein above) is provided to reduce the volume and increase the pressure of the electrolyzed gases for storage and transit to population and industrial centers. A delivery means 22 may be provided, such as high pressure containers for shipping or gas pipelines for transporting the gases to end user(s) 23. Because of the volatility of gases when combined, the hydrogen and oxygen transmission lines are preferably laid some distance apart. If transported by train, ship or truck, the respective component gases are preferably not transported by the same conveyance. The pipelines should be of a substantial nature such as those used for natural gas, and may include suitably adapted natural gas pipelines.

Figure 9:
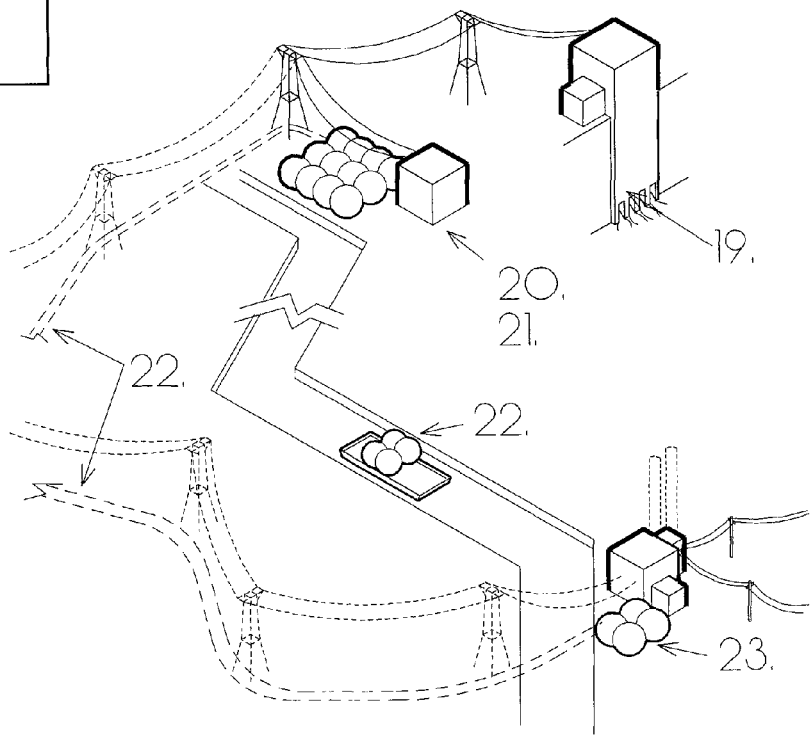
FIG. 9 is an isometric view of an exemplary embodiment of a method provided in accordance with the present invention.

FIG. 9 illustrates the hydrogen fuel cycle where 19 is the (preferably renewable) power source. In this illustration, a new or existing hydroelectric plant is depicted. Electrical power is transmitted a short distance to an electrolysis plant with compression and storage facilities, 20 and 21. 22 indicates two means of transportation, in this illustration, by barge, and by pipeline where existing high tension transmission is replaced with buried pipelines and transported long distances to the end user, which may be a converted fossil fuel plant, a fuel cell electric generation station, or a local terminal for distribution to homes and other buildings for heating, reconversion to electricity with fuel cells, or vehicle fuelling stations. In this illustration, a converted former fossil fuel burning plant is shown. By way of further example, the transported hydrogen may be used for industrial uses requiring hydrogen, such as ammonia production, and the like.

Figure 10:
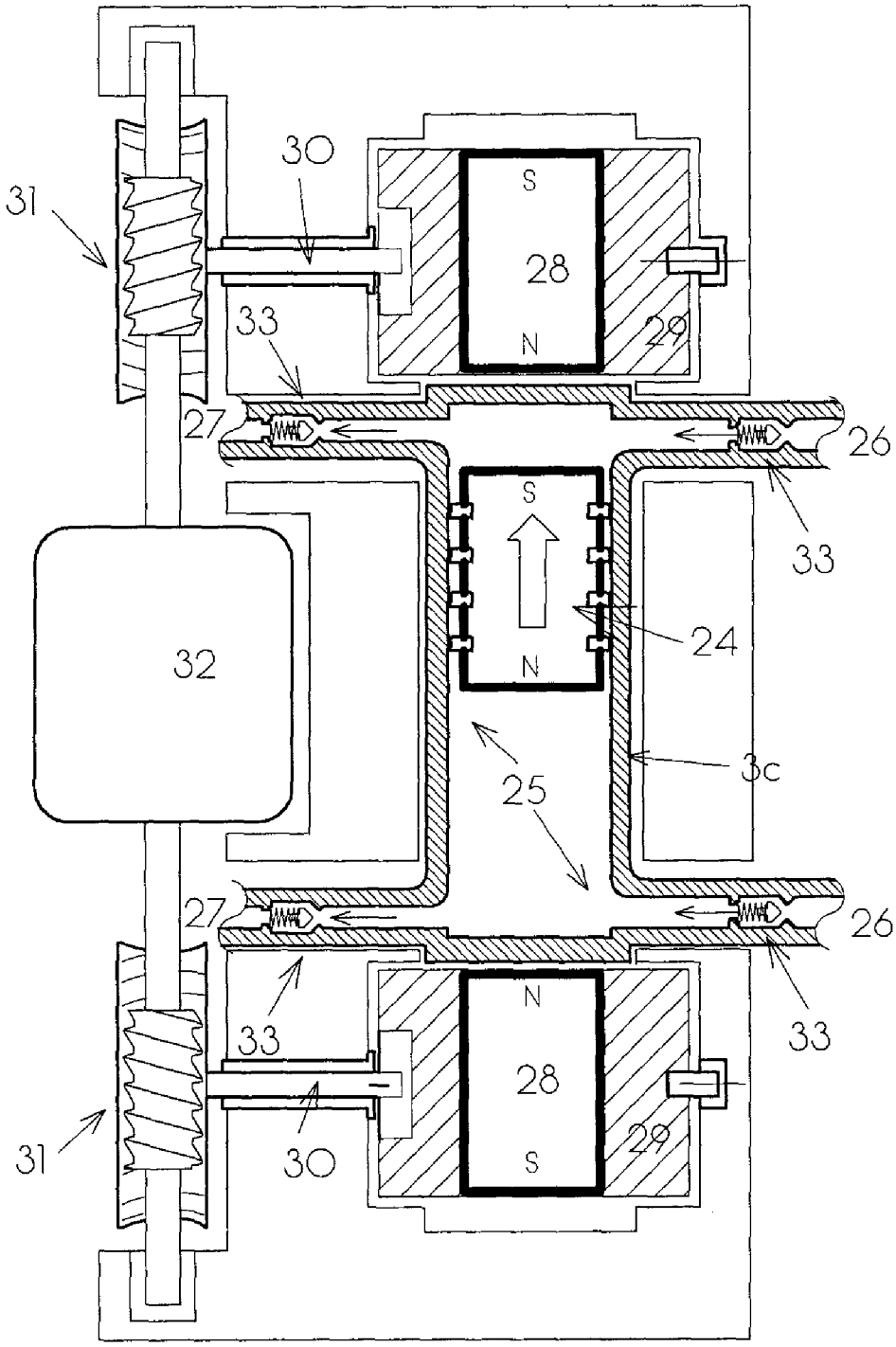
FIG. 10 is a vertical sectional view of a sixth representative embodiment of a device made in accordance with the present invention.

FIG. 10 is a vertical section through a sixth design of an exemplary double-acting compressor/pump which does not utilize electromagnetic force as motivation, but instead uses mechanically actuated permanent magnets. Specifically, a motor 32 drives two rotating permanent magnets 28 which are synchronized, in this illustration, by gearing 31. A permanent magnet piston 24 is both repelled by one of the rotating magnets and attracted by the other. As the rotating magnets turn 180 degrees, the permanent magnet piston is then both attracted and repelled in the other direction. As with the previous double acting compressor/pumps, gases or fluids enter the compressor chambers through inlets 26, and check valves 33 prevent back-flow. As the piston compresses the gases in one chamber, gases enter into the chamber at the other end of the piston. When the direction of the piston is reversed, compression occurs on the alternate side of the cylinder. As illustrated, the magnets 28 are mounted in generally cylindrical rotating magnet holders 29. Magnet holders 29 are rotated about an axis by rotating shafts 30. Shafts 30, in turn, are rotated by worm gears 31, which are connected to a mechanical drive 32 which may be driven by electric motors or a mechanical take-off, for example, from a water or wind-driven device. While the illustration depicts the drive mechanism as a worm gear drive, other systems of motivation such as toothed belts and cogs may be used as known in the art. In addition, magnet holders 29 may be driven independently to permit independent timing of the rotation of magnets 28 if required to obtain a desired movement of the piston.

Figure 11:
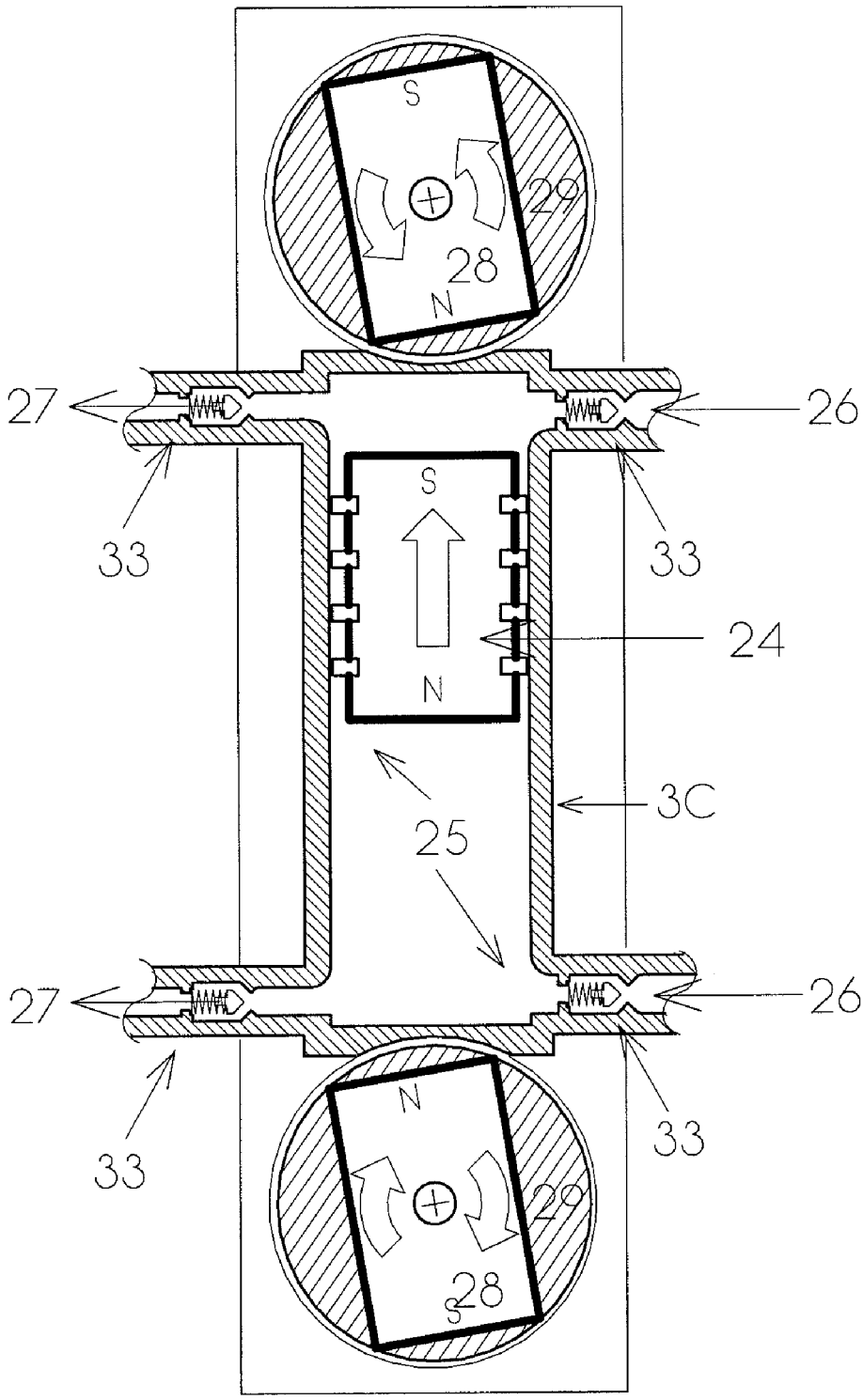
FIG. 11 is a horizontal sectional view of the embodiment of FIG. 10.

FIG. 11 is a horizontal section through the exemplary double-acting compressor/pump of FIG. 10. FIG. 11 further illustrates the rotating drum magnet holders 29 containing the permanent magnets 28. When one rotating magnet's north pole faces the north pole of the piston, magnetic force repels the piston and at the same moment in their rotation, the opposite rotating magnet's north pole is attracting the piston's south pole. When both rotating magnets turn half-way, the piston is propelled in the other direction.

Figure 12:
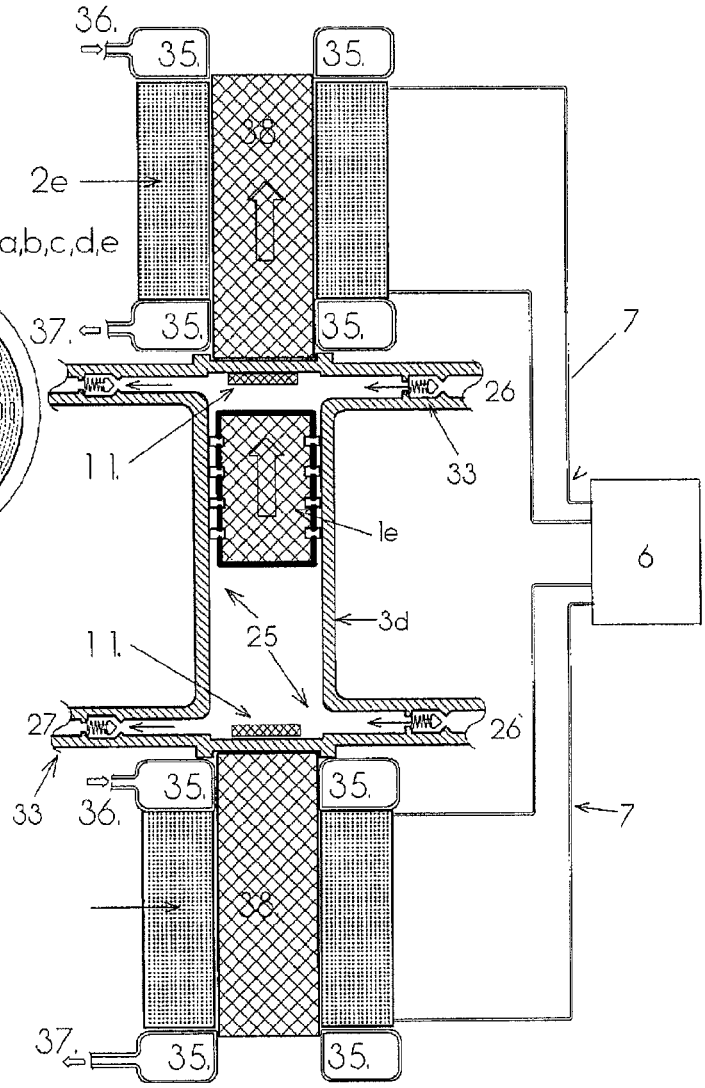
FIG. 12 is a sectional view of a seventh representative embodiment of a device made in accordance with the present invention.

FIG. 12 illustrates a seventh exemplary embodiment. The embodiment of FIG. 12 is a double-acting electromagnetic compressor/pump wherein the electromagnetic coils are at the ends of the cylinder housing 25 and are preferably formed around permeable iron cores 38. When alternately energized by the control unit 6, an iron piston 1*e* is attracted to one core, and then the other. There is no magnetic repulsion with the iron piston, only attraction. It is believed that in this design, there is no practical limitation to the electromotive force available to drive the piston and this design may have the best potential for high compression pressures. Cooling manifolds 35 at each end of each electromagnetic coil including inlets 36 and outlets 37 supply forced air, coolant or cryogenic liquids to remove heat and control the temperature of the coils 2*e*. The outlets 37 directs the coolant to condensers, heat exchangers or other means of heat dissipation. The coolant is then recirculated to the coils. The inlets 26 channel lower pressure gas into compression chambers and outlet ports 27 lead working fluid at elevated pressures to the next stage of compression.

Figure 13:
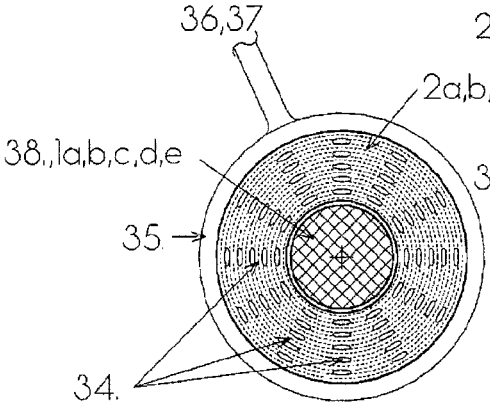
FIG. 13 is a transverse section through an electromagnetic coil that may be employed in some of the disclosed embodiments.

FIG. 13 illustrates a section through an electromagnetic coil 2 *a, b, c, d* and *e*. 34 indicates cooling ducts linking the cooling manifolds 35. In cross sections through coils 2 *a*, b, c and *d*, 38 is a section through the cylinder housing 3, and piston 1*a, b, c* and *d*. In the seventh exemplary design above, 38 is a stationary permeable iron core. 36 and 37 indicate the inlet or outlet to the cooling manifolds.

If wasteful high tension transmission is replaced by a system as described herein, the rights-of-way currently used by electrical power transmission may also be used for laying new pipelines 22 as depicted in FIG. 9. The end user may include converted fossil-fuel generating plants that may burn the gases pollution-free to produce a water by-product. By way of further example, the hydrogen and oxygen can be combined electrochemically in fuel cell plants supplying whole communities or neighborhoods. End user 23 may further include fueling stations, businesses or residences employing fuel cells or other processes requiring hydrogen as a fuel source.

By way of further example, the creation of electrolysis plants at locations where existing hydroelectric facilities are located using off-peak power, and at new locations, in locations where alternate natural power exists may eliminate the need and use of the high tension transmission of electricity. The continuing development of fuel cell technology requires hydrogen and oxygen and will likely be the method of power generation in the future. With no smokestacks and pollution, power generation can be performed in small power generation pods and housed in small buildings resembling the residential or commercial buildings surrounding them. Local electrical generation does not require extended power transmission distances with the further benefit of eliminating widespread black-outs as have happened several times in the previous half century.

By way of still further example, pumps and compressors as described herein may be used for applications besides gas transportation and storage. For example, because of the simplicity of the design and possible low power requirement of this device, it may be possible accordingly to use a pump powered by photovoltaic cells to pump water from wells into tanks during daylight hours for potable use in areas of the world where electricity is not available and disease carried by contaminated water is prevalent. The output of photovoltaic cells and power needs of the electromagnet induction coils may both be direct current so no current inversion is required. However, it will be recognized that the present embodiments may also be actuated by alternating current, as desired.

The direction of present hydrogen-powered vehicles by the U.S. Department of Energy in pilot projects is to electrolyze water with electricity from the grid, at the locations where the fuel is dispensed into vehicles equipped with fuel cells that convert the gases back into electricity, driving electric motors. Ideally, such a system can involve a double hydrogen fuel cycle, wherein the first cycle converts electricity from natural sources (such as hydroelectric power) into hydrogen and oxygen which are transported by containers or pipeline to local electrical generation, and at the service station, the electricity can be used to electrolyze water back into gases which are then used to generate electricity in the vehicle or burned as a fuel in specially designed combustion engines. Additionally, a single cycle may be used wherein piped gases can be directly piped to the service station, stored and dispensed as needed.

It may be found that if the electrolyzing of water for the production of pollution-free fuel does become the major fuel source in the future, such wide-spread consumption of hydrogen from one area of the globe, valving-off the accompanying oxygen at the natural power source location, and then recombining the transported hydrogen with oxygen at the use location may cause an imbalance in the atmosphere that might cause environmental problems. It is submitted that the oxygen and hydrogen preferably be transported and used in suitable proportional quantities.

In summary, the devices disclosed herein provide a compressor or pump having the compressing or pumping piston wholly contained and isolated within inside the vessel containing the gas or liquid. The magnetic coil or coils, control unit and all other pump apparati may then be maintained externally to the vessel thus eliminating leakage of light gases through moving seals or gaskets as is prevalent with reciprocal crankshaft driven compressors and most other compressors. Because of the simplicity of the disclosed compressors/pumps, it is believed by Applicant that maintenance will be reduced or may even be eliminated. This is further facilitated by the disclosed devices having a limited number of moving parts. The devices preferably operate with low power consumption using direct current (but may also be adapted to use alternating current, if desired), and the disclosed devices are capable of compressing hydrogen and other low density gases with virtually no loss, since any gases slipping past the piston seals are not lost from the system, but will instead simply be compressed during a later stroke of the piston.

It will be appreciated that electromagnetic windings described herein for driving electromagnets may be situated in any desired orientation to effectuate any desired movement in any piston. It will be further appreciated that such windings can be formed from any desired material, such as copper and copper alloys, aluminum, silver and the like, as well as superconductive materials, such as HTS materials.

The methods and systems of the present invention, as described above and shown in the drawings, provide for pumping and compressor devices with superior properties including lower leakage and improved performance, as well as enabling a new hydrogen-based energy infrastructure. It will be apparent to those skilled in the art that various modifications and variations can be made in the device and method of the present invention without departing from the spirit or scope of the invention. Thus, it is intended that the present invention include modifications and variations that are within the scope of the subject disclosure and equivalents.

What is claimed is:

1. A fluid pump, comprising:

a) a generally sealed vessel defining a longitudinal bore therein, wherein the longitudinal bore defines a central axis along a centerline of the bore, and wherein the only passages through the vessel leading into the bore include at least one working fluid inlet and at least one working fluid outlet;

b) a piston adapted and configured to be received in the bore; and c) a magnetic drive external to the bore, including:

i) a first magnet disposed proximate a first end of the bore adapted to rotate about a first axis generally perpendicular to the central axis; and ii) a second magnet disposed proximate a second end of the bore adapted to rotate about a second axis generally perpendicular to the central axis;

wherein the magnetic drive is adapted and configured to cause the piston to move along a path defined by the bore when the first magnet is rotated about the first axis and the second magnet is rotated about the second axis.

2. The pump of claim 1, wherein the first and second magnets are rotated by a mechanical drive shaft.

3. The pump of claim 2, wherein the first and second magnets are coupled to a single drive shaft.

4. The fluid pump of claim 1, wherein the pump is adapted and configured to pump hydrogen.

5. The fluid pump of claim 1, further comprising at least one check valve in the fluid path of at least one of the working fluid inlet and the working fluid outlet.

6. The fluid pump of claim 1, wherein the piston includes a plurality of seals disposed about its periphery adjacent the bore.

7. The fluid pump according to claim 6, wherein gas passing over the seals during a compression stroke may be recovered and compressed during a subsequent compression stroke of the pump.

8. A pump according to claim 1, wherein the piston includes non-magnetized iron material.

9. A pump according to claim 1, wherein the piston includes a permanently magnetized material.

10. A pump according to claim 1, wherein the piston includes diamagnetic material.

11. A pump according to claim 1, wherein the magnetic drive includes at least one permanent magnet.

12. A pump according to claim 11, wherein the first magnet is a permanent magnet and is adapted and configured to rotate about the first axis between a first orientation wherein a first pole of the first magnet is closest to the bore, and a second orientation wherein the first magnet is rotated 180° about the first axis with respect to the first orientation, wherein a second pole of the first magnet is closest to the bore in the second orientation.

13. A pump according to claim 12, wherein:

a) the second magnet is a permanent magnet; and b) the second magnet is adapted and configured to rotate about the second axis between a first orientation wherein a first pole of the second magnet is closest to the bore, and a second orientation wherein the second magnet is rotated 180° about the first axis with respect to the first orientation, wherein a second pole of the second magnet is closest to the bore.

14. A pump according to claim 1, wherein the first axis is displaced from the second axis.

15. A pump according to claim 1, wherein the first axis is parallel to the second axis.

16. A pump according to claim 1, wherein the piston is actuated only by permanent magnets.

17. A pump according to claim 1, further including at least one valve disposed in an end surface of the bore.

18. A pump according to claim 1, further including a cooling jacket for removing heat from the pump during operation.

* * * * *